US012742614B2

(12) United States Patent
Glick

(10) Patent No.: US 12,742,614 B2
(45) Date of Patent: Sep. 22, 2026

(54) RAPID DEPLOYMENT SECURITY FENCE

(71) Applicant: Amos B. Glick, Gap, PA (US)

(72) Inventor: Amos B. Glick, Gap, PA (US)

( * ) Notice: Subject to any disclaimer, the term of this patent is extended or adjusted under 35 U.S.C. 154(b) by 253 days.

(21) Appl. No.: 18/417,987

(22) Filed: Jan. 19, 2024

(65) Prior Publication Data

US 2025/0085090 A1 Mar. 13, 2025

Related U.S. Application Data

(63) Continuation-in-part of application No. 17/833,349, filed on Jun. 6, 2022.

(60) Provisional application No. 63/197,725, filed on Jun. 7, 2021.

(51) Int. Cl.

*F41H 5/24* (2006.01)
*E04H 17/00* (2006.01)
*E04H 17/18* (2006.01)

(52) U.S. Cl.

CPC ..... *F41H 5/24* (2013.01); *E04H 17/003* (2013.01); *E04H 17/18* (2013.01)

(58) Field of Classification Search

CPC ..... E04H 17/009; E04H 17/18; E04H 17/23; E04H 17/17; E04H 17/168; E04H 17/1452; E04H 17/1456; E04H 17/1488; E04H 17/20; E04H 17/22; F41H 5/13; F41H 5/24; F41H 5/0442; F41H 5/0457; F41H 5/0464

See application file for complete search history.

(56) References Cited

U.S. PATENT DOCUMENTS 147,449 A * 2/1874 Tinkham ..... E04H 17/16 256/31
160,711 A * 3/1875 Prickett ..... E04H 17/16 256/28
176,990 A * 5/1876 Overpeck ..... E04H 17/16 256/31
534,389 A * 2/1895 Duncan ..... E04H 17/16 256/24

(Continued)

FOREIGN PATENT DOCUMENTS

CA 2806405 A1 * 8/2013 ..... E04H 17/168
DE 9113405 U1 * 4/1992

(Continued)

*Primary Examiner* — Jonathan P Masinick
(74) *Attorney, Agent, or Firm* — Miller Law Group, PLLC

(57) ABSTRACT

A rapidly deployable portable security fence has individual panels formed with bullet resistant material sandwiched in the middle of the panel structure between sheets of aluminum. Each panel has saw tooth blades and a formed deflector panel mounted at the top thereof to deter people from scaling and climbing over the security fence. The structure of the fence and method of deploying the fence results in a rapid deployment to provide a temporary and removable security fence in situations and locations where a permanent bullet resistant security fence is not desired or has not yet been installed. The panels are supported by H-beam support posts receiving the panels at the opposing edges thereof. The fence is maintained in a vertical orientation by stabilizers on opposing sides thereof, such as telescopic legs. A securement apparatus pulls the panels toward the support past to integrate the panels and the support posts together.

20 Claims, 12 Drawing Sheets

(56) References Cited

U.S. PATENT DOCUMENTS 1,899,735 A 2/1933 McClintock
3,353,795 A * 11/1967 Muller ..... E01F 15/06 52/298
4,061,815 A * 12/1977 Poole, Jr. ..... B32B 27/065 428/425.9
4,116,420 A * 9/1978 Hazelett ..... E04H 17/16 256/73
5,406,039 A * 4/1995 Rerup ..... E01F 8/0011 181/294
5,429,340 A 7/1995 Young
5,984,044 A * 11/1999 Christensen ..... E01F 8/0023 181/210
6,371,699 B1 * 4/2002 Weinreb ..... E02D 29/0241 405/262
7,520,207 B1 * 4/2009 Fuqua ..... F41H 5/013 109/82
7,658,042 B2 * 2/2010 Hiel ..... C04B 28/34 52/762
8,001,880 B2 8/2011 White
8,726,780 B2 * 5/2014 White ..... F41H 5/08 89/36.07
8,875,461 B2 * 11/2014 Kestermont ..... E04B 1/10 52/407.3
8,956,711 B2 * 2/2015 Musaefendic ..... B32B 15/14 89/36.01
9,746,289 B2 * 8/2017 Hahn ..... F41H 5/06
10,012,479 B2 7/2018 Boviall
10,119,791 B2 * 11/2018 Bourque ..... B29C 70/86
10,145,655 B2 * 12/2018 Rockenfeller ..... F41H 5/0471
10,221,529 B1 * 3/2019 Sanders ..... H02G 3/386
10,281,245 B2 5/2019 DeKort
10,337,205 B2 * 7/2019 Westfahl ..... E04H 17/23
10,539,398 B2 * 1/2020 Rodrigues ..... B32B 3/30
10,584,513 B2 * 3/2020 Boado ..... E04H 17/1417
10,663,263 B2 * 5/2020 Boyd, III ..... B42F 7/08
10,663,264 B1 * 5/2020 Spradlin, Sr. ..... F41H 5/013
10,689,819 B2 * 6/2020 Neusch ..... E01F 15/0461
10,753,711 B2 * 8/2020 Muth ..... E05D 7/1005
11,479,931 B2 * 10/2022 Wilson ..... E01F 8/0064
11,702,856 B2 * 7/2023 White ..... F41H 5/013 52/506.01
11,747,114 B2 * 9/2023 Glick ..... F41H 5/026 89/36.04
11,781,839 B1 * 10/2023 Barr ..... F41H 5/08 89/36.02
2007/0028758 A1 * 2/2007 Melin ..... F41H 5/04 89/36.02
2007/0062146 A1 * 3/2007 Van Dijk ..... E04C 2/22 52/580
2007/0245933 A1 * 10/2007 Kramer ..... F41H 5/24 109/49.5
2008/0307553 A1 * 12/2008 Jbeili ..... F41H 5/0471 2/2.5
2010/0282062 A1 * 11/2010 Sane ..... F41H 5/0457 89/937
2011/0239851 A1 * 10/2011 Mason ..... B32B 15/20 89/917
2012/0103178 A1 * 5/2012 Dijkman ..... F41H 5/04 264/109
2015/0354926 A1 12/2015 Gibson
2016/0376803 A1 * 12/2016 Monk ..... E04C 2/526 52/282.1
2020/0256646 A1 * 8/2020 Hall ..... F41H 5/0428
2023/0417512 A1 * 12/2023 Glick ..... F41H 5/013

FOREIGN PATENT DOCUMENTS

DE 102008056299 A1 * 5/2010 ..... E04H 17/168
DE 202011106893 U1 * 11/2011 ..... E04H 17/16
DE 202014000716 U1 * 2/2014 ..... E04H 17/20
DE 102020116734 A1 * 12/2021 ..... E04H 17/18
EP 0381289 A1 * 8/1990 ..... E04H 17/163
EP 2642046 A1 * 9/2013 ..... E04H 17/16
EP 2765259 A1 * 8/2014 ..... E04H 17/168
FR 2930867 A1 * 11/2009 ..... E04H 17/168
FR 3041012 B1 * 9/2017
FR 3066211 A3 * 11/2018 ..... E04H 17/168
GB 2306977 A * 5/1997 ..... E04H 17/168
KR 200418034 Y1 * 6/2006 ..... E04H 12/2276
KR 200429832 Y1 * 10/2006 ..... E01F 8/0023
KR 100898577 B1 * 5/2009 ..... E04H 17/168
KR 100976636 B1 * 8/2010 ..... E04H 12/2276
KR 101035430 B1 * 5/2011 ..... E04H 17/22
KR 20120012546 A * 2/2012 ..... F41H 5/0471

* cited by examiner

Fig. 8
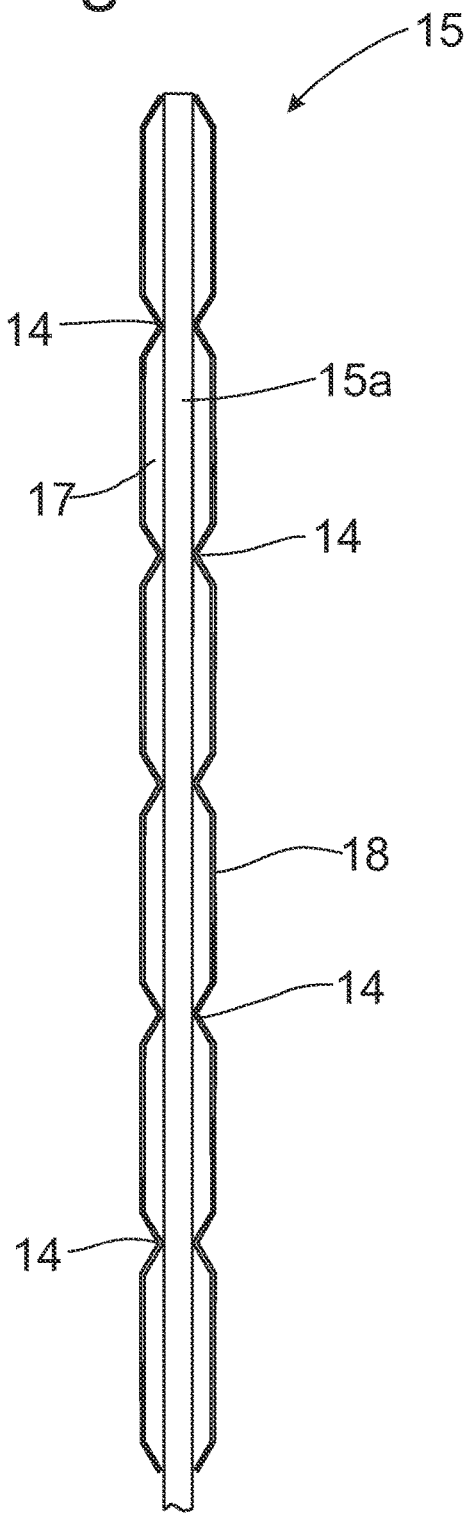
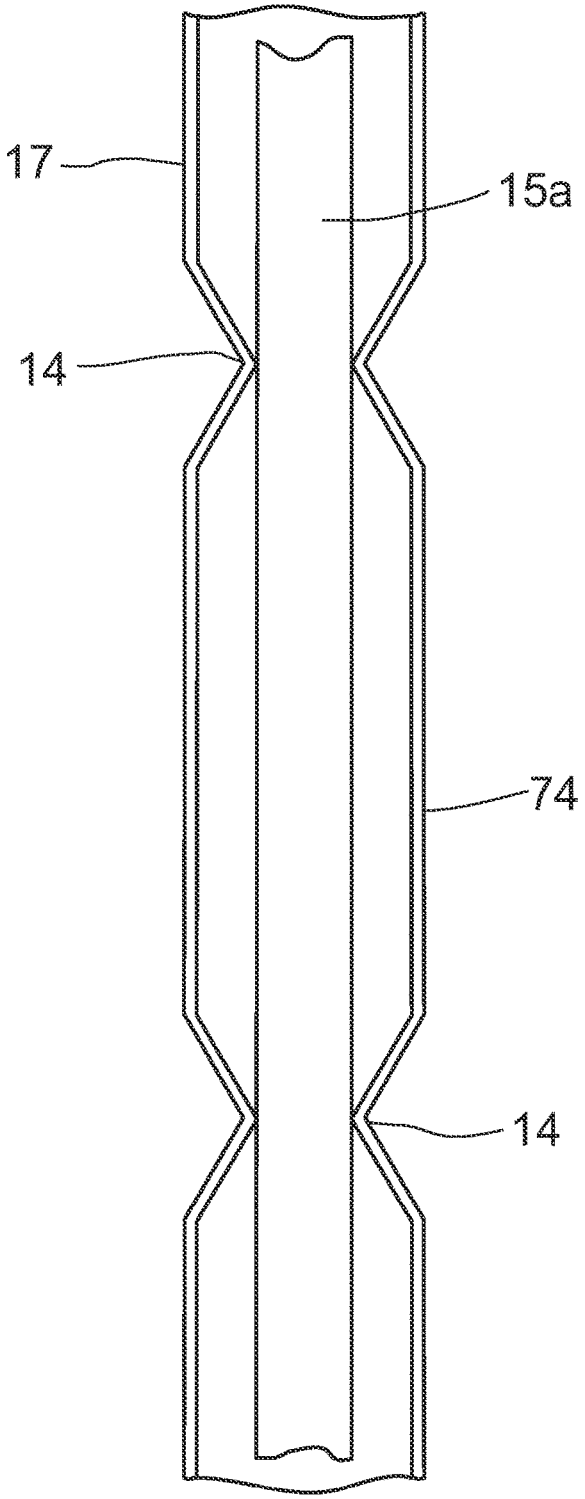
Fig. 9

Fig. 15
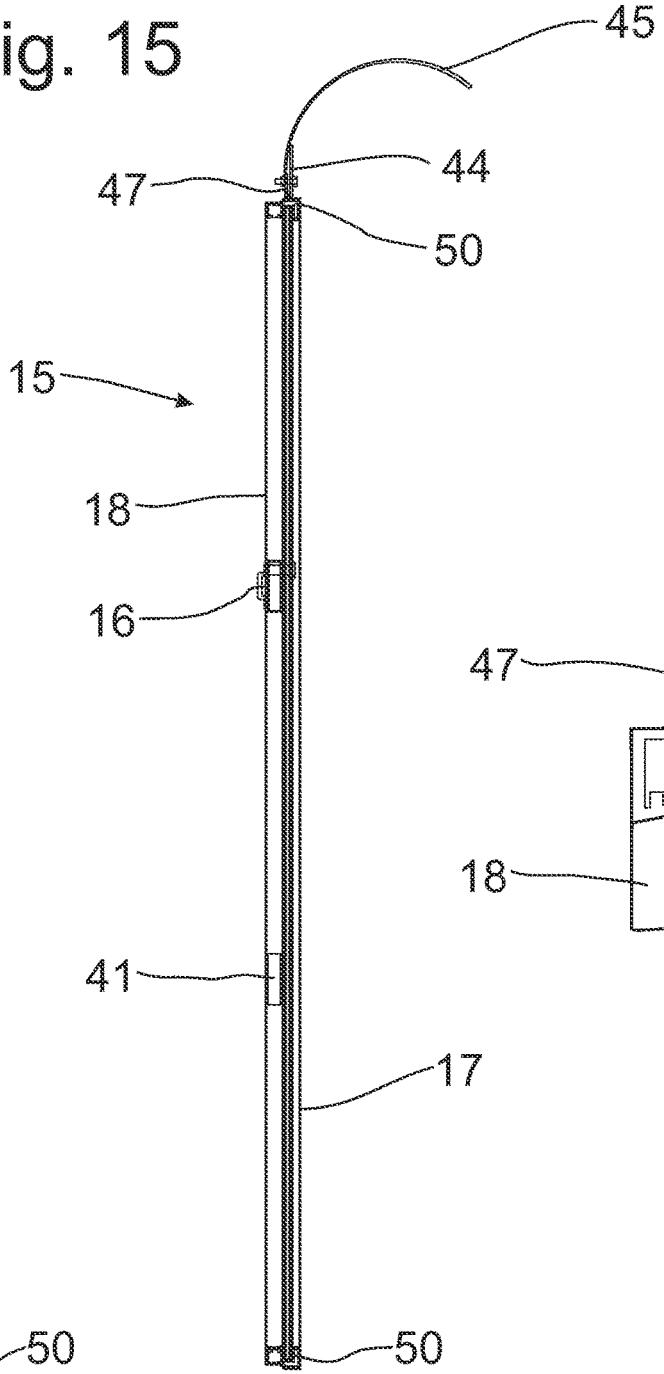
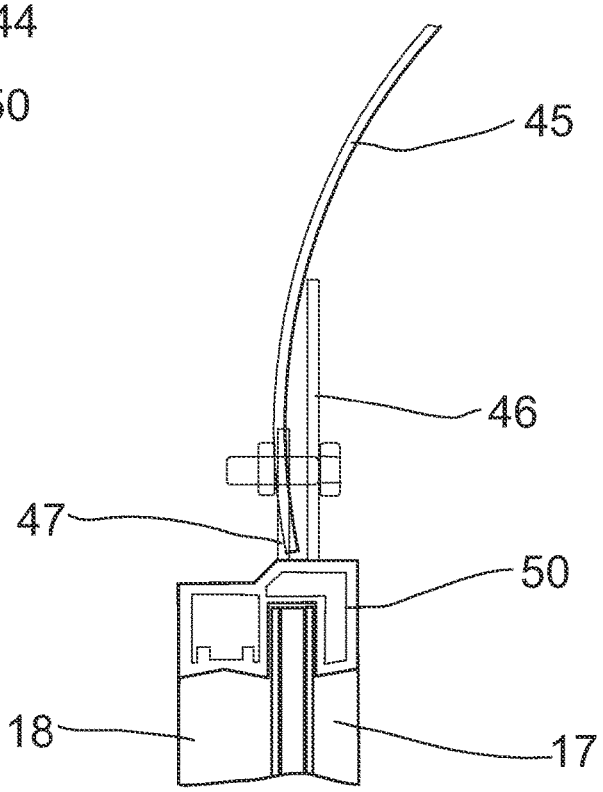
Fig. 16
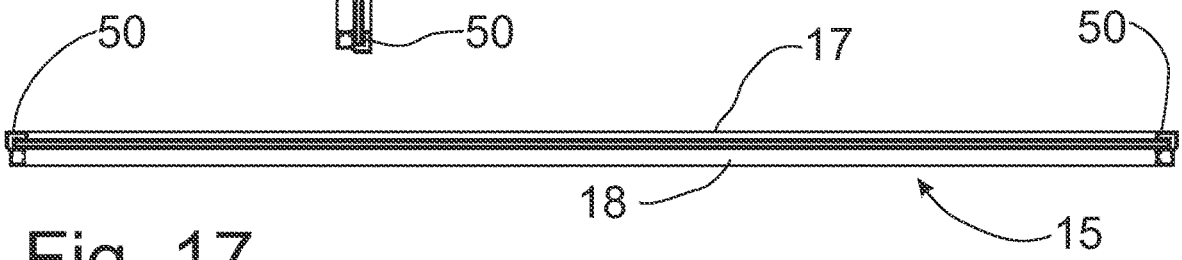
Fig. 17

Fig. 18
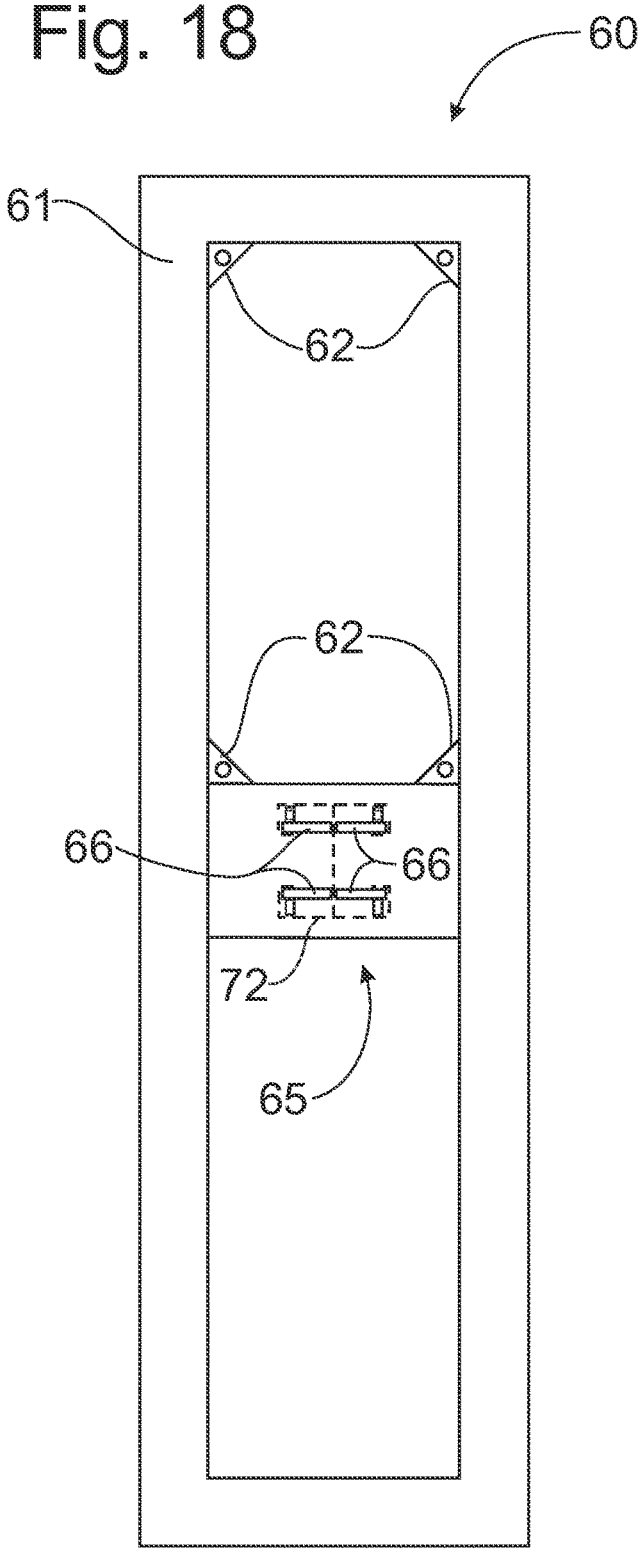
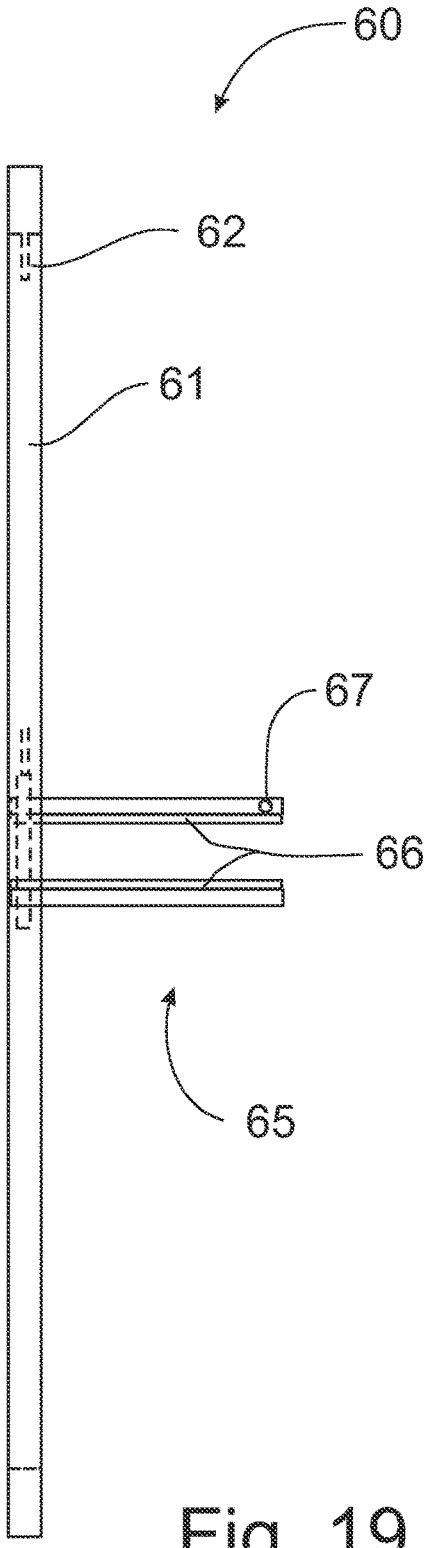
Fig. 19

Fig. 20
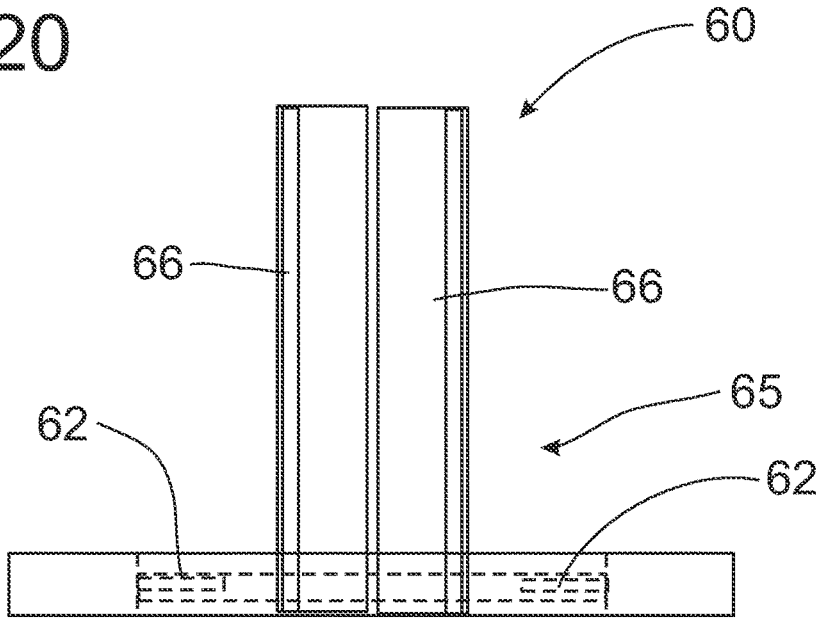
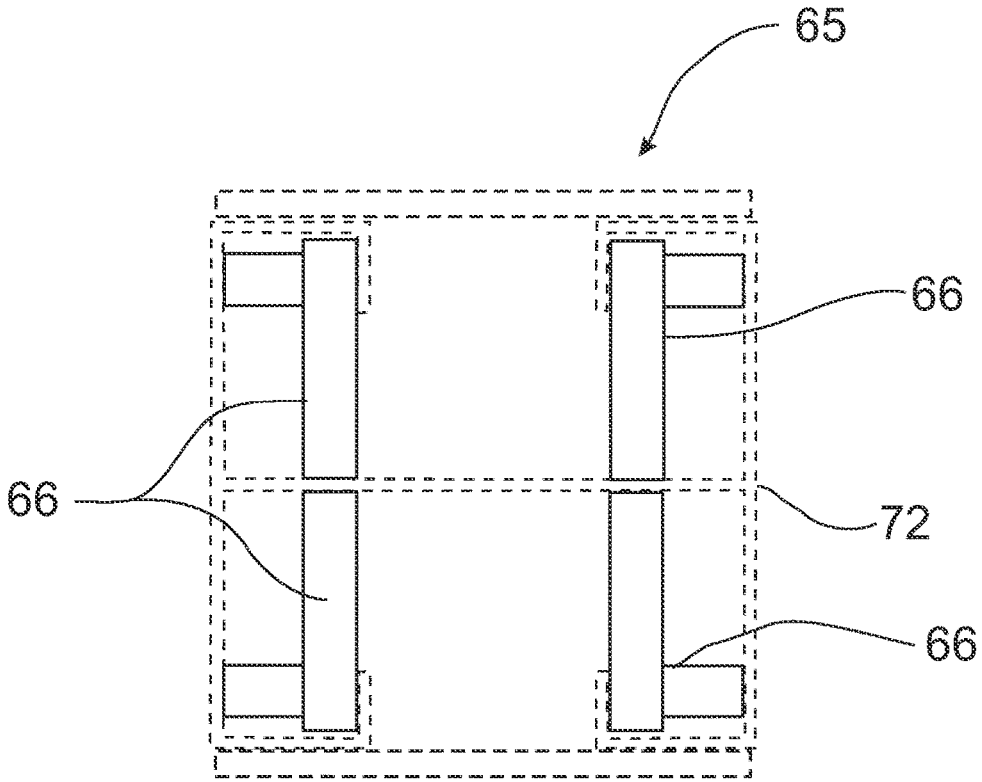
Fig. 21

Fig. 22
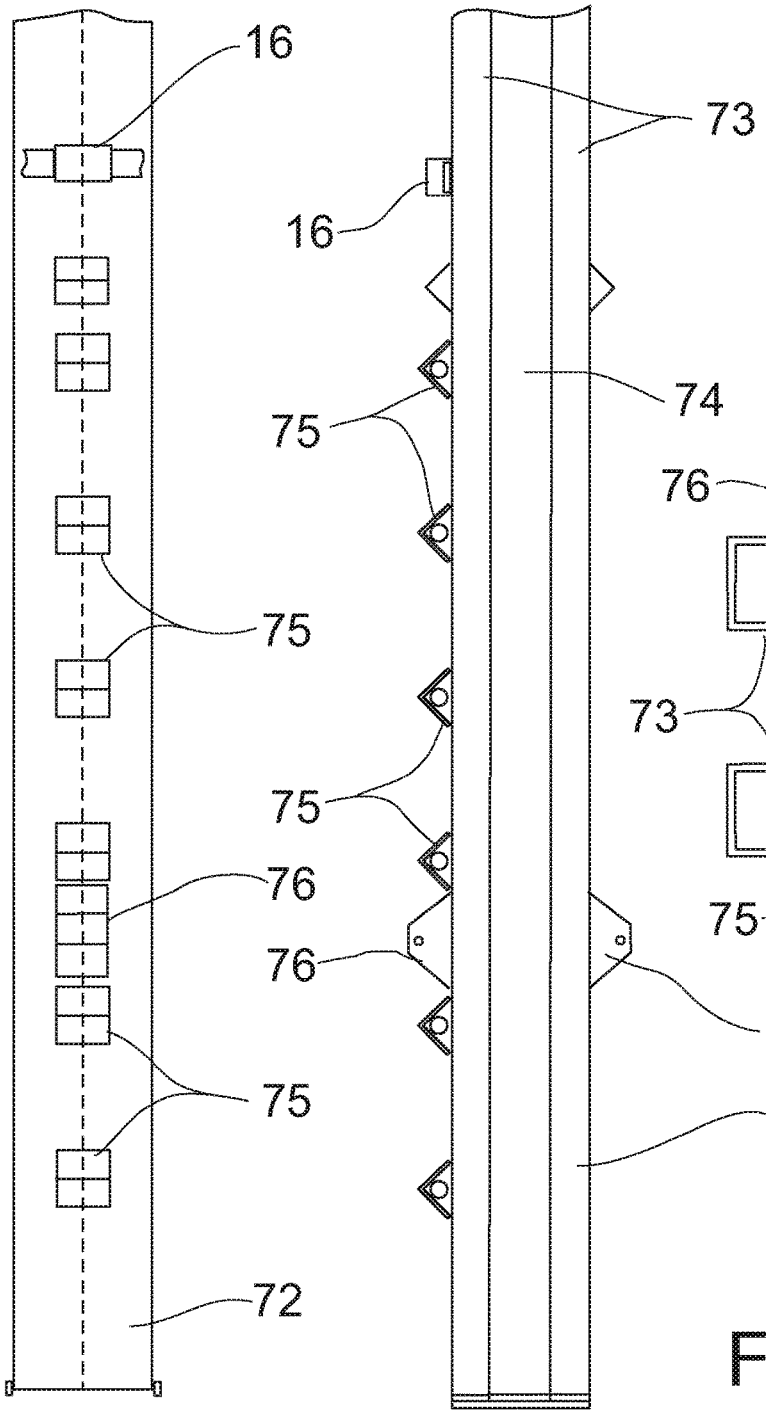
Fig. 24
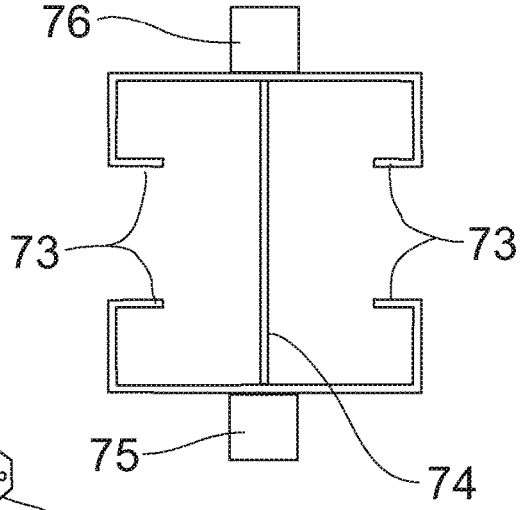
Fig. 23

RAPID DEPLOYMENT SECURITY FENCE

CROSS-REFERENCE TO RELATED APPLICATIONS

This application is a continuation-in-part of U.S. patent application Ser. No. 17/833,349, filed on Jun. 6, 2022, which claims domestic priority on U.S. Provisional Patent Application Ser. No. 63/167,725, filed on Jun. 7, 2021, the contents of which are incorporated herein by reference.

FIELD OF THE INVENTION

This invention relates generally to a security fence that can be deployed rapidly to provide a barrier between geographical spaces and to provide ballistic security by incorporating ballistic materials within the security fence structure, as well as to provide a resistance to impact from large objects, such as vehicles.

BACKGROUND OF THE INVENTION

Ballistic barriers have been designed and provided to resist and/or prevent the passage of bullets fired at the barrier. Such ballistic barriers have been used at indoor shooting ranges, as security fences for residences and commercial property and other establishments, and as shields for individuals advancing under fire. Ballistic barriers are typically formed of bullet resistant metal and are heavy and difficult to use because of their weight. As security fence structures, the weight of the panels are difficult to install and to maintain.

In U.S. Pat. No. 1,899,735, granted on Jan. 22, 1632, to O. B. McClintock, a security barrier for bank tellers is disclosed in which the barrier is formed from a metal shell supporting bullet resistant glass and a complex structure to provide protection for a bank teller. A modular security fence is disclosed in U.S. Pat. No. 5,429,340, granted on Jul. 4, 1695, to Anthony M. Young, et al, in which the security fence is formed from overlapping panel modules. Each module is formed as an irregularly shaped open shell that interlocks with one or more adjoining modules or shells. Ballistic resistance is a result of opposing outer walls of the open shells when assembled together.

A ballistic barrier is disclosed in U.S. Pat. No. 8,001,880, granted to William C. White, et. al., on Aug. 23, 2011, wherein a lower barrier supports attack resistant panes extending upwardly from the barrier. The lower barrier provides protection from vehicle crashes, while the upper attack resistant panes are formed from material, such as plastic, acrylic and polycarbonates, among others, to resist penetration by bullets, particularly rounds fired by handguns. The ballistic wall structures disclosed in U.S. Patent Publication No. 2015/0354926, published on Dec. 10, 2015, by MGM Holdings, LLC, are designed for use in shooting ranges. The intent of this ballistic wall structure is to retain bullets within the wall structure. A ballistic curtain formed of ballistic rubber allows the passage of a bullet, while slowing the speed of the bullet so that the inner plate 54 stops the penetration of the bullet. The rubber curtain also prevents ricochets and fragments from passing back through the curtain.

Another ballistic barrier is disclosed in U.S. Pat. No. 10,012,479, granted to Michael Boviall on Jul. 3, 2018. This ballistic barrier is formed by a wall incorporating louvers or slats angled and overlapping to provide resistance to the passage of bullets by deflecting the path of the bullets downwardly to the ground. IN an alternative embodiment, the angled slats are backed by a backer plate that serves to further deflect the path of the bullets. A ballistic barrier designed to be portable in discrete panels and assembled in a selected location is disclosed in U.S. Pat. No. 10,281,245, granted on May 7, 2016, to Michael J. DeKort. Each panel can be connected to adjoining panels by hinges, and can, thereby, be folded for portability. Each panel is formed with a single pane of solid metal to provide bullet resistance.

It would be desirable to provide a bullet resistant fence structure that can be assembled and deployed rapidly and easily and also be effective to resist the passage of bullets therethrough up to a predetermined caliber of weapon.

It would also be desirable to provide a bullet resistant fence structure that can also resist the impact from a motor vehicle.

SUMMARY OF THE INVENTION

It is an object of this invention to overcome the disadvantages of the prior art by providing a crash resistant security fence that provides an aesthetically pleasing appearance.

It is another object of this invention to provide a bullet resistance security fence that is configured to be deployed quickly at locations not having a security fence installation.

It is a feature of this invention that the security fence is configured as a plurality of modular panels that can be detachably secured to adjacent modular panels.

It is another feature of this invention that the modular panels can be positioned between vertical support posts to enable rapid deployment.

It is still another feature of this invention that a securement device corresponds to each support post having a modular panel on opposing sides thereof to engage the modular panel on each opposing side thereof.

It is an advantage of this invention that the securement device corresponding to each intermediate support post is operable to pull the opposing modular panels toward the corresponding intermediate support post.

It is another advantage of this invention that the support posts have an H-shaped cross-section to receive the modular panels into opposing sides thereof.

It is yet another feature of this invention that each of the support posts are provided with a stabilizing apparatus to maintain the support post in a vertical orientation as the security fence is being deployed.

It is still another advantage of this invention that the stabilizing apparatus can be formed with a pair of adjustable length telescopic legs pivotally connected to opposing sides of said support post.

It is yet another advantage of this invention that each telescopic leg includes a stabilizing arm pivotally attached to the corresponding side of said support post.

It is a further feature of this invention that the telescopic legs permit positioning of the stabilizing apparatus to engage an adjacent supporting surface at different respective heights relative to the corresponding support post.

It is another object of this invention to provide a method of rapidly deploying a bullet resistant security fence to provide a temporary and removable security fence in situations and locations where a permanent bullet resistant security fence is not desired or has not yet been installed.

It is still a further feature of this invention that the method of rapidly deploying a bullet resistant security fence includes the step of positioning a plurality of support posts, including end posts and intermediate support posts positioned between the end posts along a desired path with adjacent support posts being spaced apart a predetermined distance.

It is yet a further feature of this invention that the method of rapidly deploying a bullet resistant security fence also includes the step of inserting extruded metal panel members between adjacent the support posts in a vertical stack to a predetermined height with each panel member having spaced front and rear walls forming an interior cavity therebetween and being configured with a tongue and groove configuration so that adjacent vertical panels are interlocked within the vertical stack of panels.

It is another feature of this invention that the method of rapidly deploying a bullet resistant security fence also includes the step of engaging a securement apparatus connected to selected panels on opposing sides of each intermediate support post to pull the panels on opposing sides of the corresponding intermediate support post toward the intermediate support post.

It is a further advantage of this invention that the engagement of the securement apparatus integrates the panels of the security fence to improve stability thereof.

It is still another feature of this invention that the method of rapidly deploying a bullet resistant security fence further includes the step of positioning a stabilizing apparatus on opposing sides of each support post into engagement with support surfaces to maintain the support posts in a vertical orientation during and after deployment of the panels into engagement with the support posts.

It is still a further advantage of this invention that the method of rapidly deploying a bullet resistant security fence includes the step of adjusting the length of the telescopic leg forming a part of each stabilizing apparatus so that the stabilizing apparatus can engage the ground outboard of the corresponding said support post.

It is still another object of this invention to provide a security fence structure and a method of deployment that enables the bullet resistant security fence to be erected rapidly and be effective to provide security temporarily to people and property inside the erected security fence.

It is yet another object to provide a rapidly deployable security fence that incorporates structure to resist people from scaling the security fence.

It is another feature of this invention that a saw tooth device is mounted on the top edge of each security fence panel to deter people from climbing over the top of the fence panel.

It is still another feature of this invention that a formed deflector can be mounted on top of each security fence panel to deter people from scaling the fence panel.

These and other objects, features and advantages are accomplished according to the instant invention by providing a rapidly deployable portable security fence having individual panels formed with bullet resistant material sandwiched in the middle of the panel structure between sheets of aluminum. Each panel has saw tooth blades and a formed deflector panel mounted at the top thereof to deter people from scaling and climbing over the security fence. The structure of the fence and method of deploying the fence results in a rapid deployment to provide a temporary and removable security fence in situations and locations where a permanent bullet resistant security fence is not desired or has not yet been installed. The panels are supported by H-beam support posts receiving the panels at the opposing edges thereof. The fence is maintained in a vertical orientation by stabilizers on opposing sides thereof, such as telescopic legs. A securement apparatus pulls the panels toward the support past to integrate the panels and the support posts together.

BRIEF DESCRIPTION OF THE DRAWINGS

The advantages of this invention will become apparent upon consideration of the following detailed disclosure of the invention, especially when taken in conjunction with the accompanying drawings wherein:

FIG. 8 is an alternative panel configuration with bullet resistant material sandwiched between opposing aluminum sheets;

FIG. 9 is an enlarged view of the panel configuration shown in FIG. 8;

FIG. 15 is a vertical cross-sectional view of the panel corresponding to lines 15-15 of FIG. 14;

FIG. 16 is an enlarged partial cross-sectional view of a top portion of the panel to depict the anti-scaling features incorporated into the panel;

FIG. 17 is a horizontal cross-sectional view of the panel corresponding to lines 17-17 of FIG. 14;

FIG. 18 is a top plan view of a flat base plate and mounting tangs for the mounting of the support post, the positioning of the support post being depicted in broken lines;

FIG. 19 is a side elevational view of the flat base plate and mounting tangs as shown in FIG. 18;

FIG. 20 is an enlarged side elevational view of central part of the flat base plate and mounting tangs;

FIG. 21 is an enlarged top plan view of the central part of the flat base plate and mounting tangs, the positioning of the support post over the mounting tangs being shown in broken lines;

FIG. 22 is a partial rear elevational view of the support post, the upper portion thereof being broken away for purposes of clarity;

FIG. 23 is a partial side elevational view of the support post, the upper portion thereof being broken away for purposes of clarity; and FIG. 24 is a top plan view of the support post incorporating the principles of the instant invention.

DETAILED DESCRIPTION OF THE PREFERRED EMBODIMENT

Figure 1:
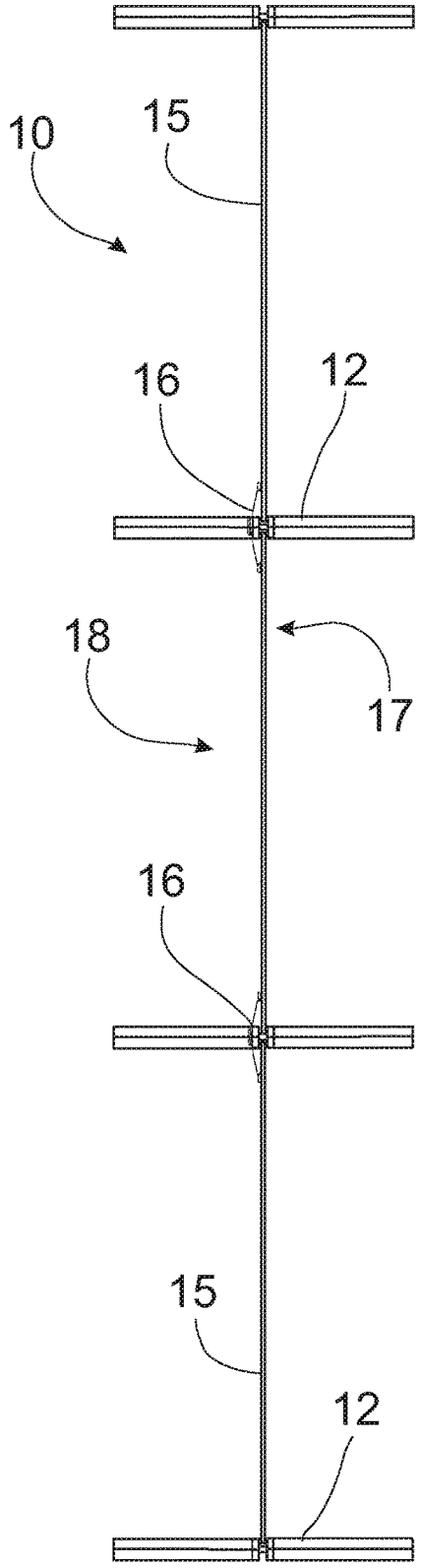
FIG. 1 is a top plan view of a security fence structure that can be quickly deployed in a temporary position and provide bullet resistance protection.
Figure 2:
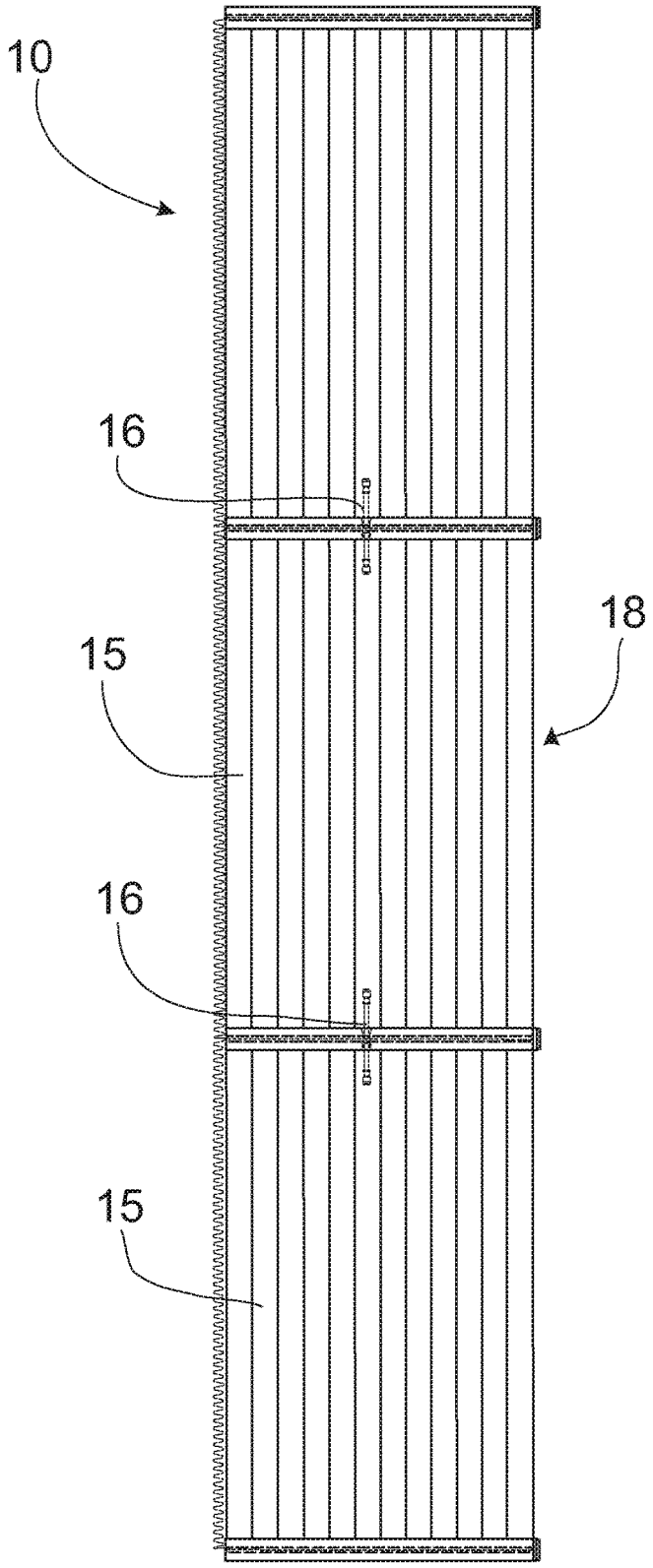
FIG. 2 is a rear elevational view of the security fence embodiment of FIG. 1.
Figure 5:
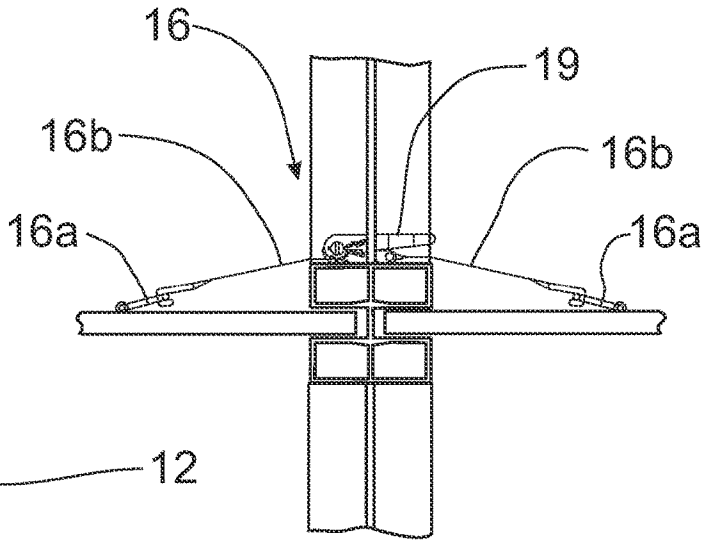
FIG. 5 is an enlarged top plan view of the portion of the security fence shown in FIG. 4.
Figure 4:
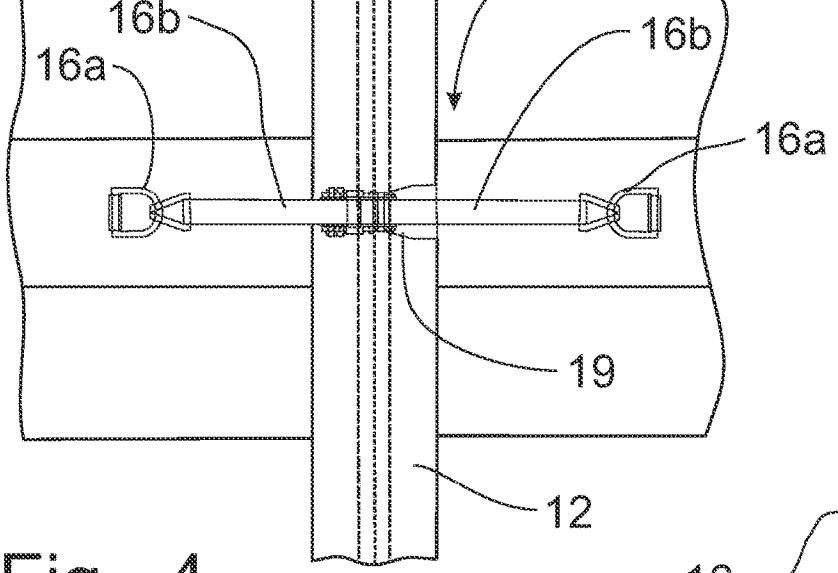
FIG. 4 is an enlarged elevational view of a portion of the security fence shown in FIG. 1 to depict the stabilizer connecting to the security fence on opposing sides of a support member.
Figure 3:
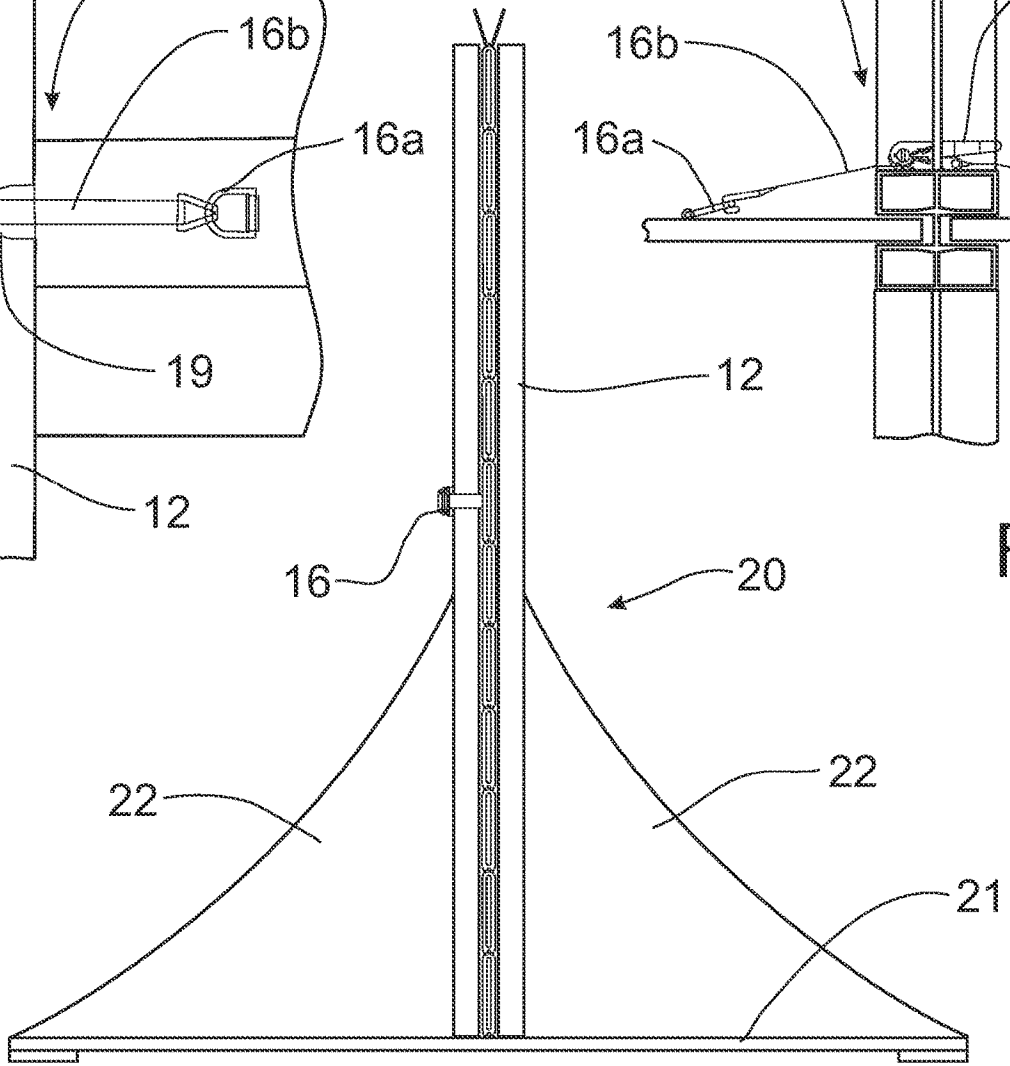
FIG. 3 is an enlarged cross-sectional view of the security fence of a FIG. 1 showing the support members.

Referring to the drawings, several embodiments of a bullet resistant, portable and rapidly deployable security fence incorporating the principles of the instant invention can be seen. In general, the security fence 10 is formed from a plurality of vertically oriented panels 15 formed in a manner to provide bullet resistant capabilities, which can have different configurations and material having a required material thickness to prevent the passage of a desired caliber of weapon. The panels 15 are preferably formed from sheets of 6061 or 6063 aluminum to define spaced apart front and rear shells 17, 18 of the panel 15 and an interior core 15*a* within the panel 15 into which the sheet of ballistic material is positioned to provide an economical and operatively effective panel 15. The thickness of the front and rear shells 17, 18 and the interior ballistic core 15*a* is a function of the level of bullet resistance that is desired. Preferably, this ballistic material is a suitable sheet of pressed ballistic material.

The security fence 10 also includes a plurality of support posts 12 each of which are positioned between adjacent panels 15 to provide support and keep the panels vertical. Preferably, the support posts 12 are positioned about ten feet apart so that the length of the individual panels 15 is slightly less than ten feet long, as the panels 15 extend horizontally between the central webs of the H-beam support posts 14. Instead of permanently mounted support posts as would be preferable in a fixed security fence structure, these support posts 12 are formed as an upright H-beam or I-beam with the fence panels 15 being received between adjacent support I-beams in the manner described above. The preferred support structure 20 also includes an elongated base 21 that is connected to the bottom of the I-beam and opposing webs 22 that project upwardly from the base 21 to the sides of the I-beam to provide stability in this standard support structure 20.

To further establish stability for the temporary security fence 10, the selected central fence panels 15 on opposing sides of a support structure 20 are connected together with securement devices 16, best seen in FIGS. 2-5. Each securement device 16 includes a ring 16*a* connected to corresponding selected fence panels 15 on opposite sides of the support post 12 of each support structure 20. A flexible strap 16*b*, which can be made of canvas, is hooked to each ring 16*a* and then connected to an over center clamp 19 that when closed draws the straps 16*b* tight around the adjacent support post 12. With the interengagement of the fence panels 15 and the clamping of the adjacent fence panels 15 into each of the support posts 12, the security fence structure 10 is stable and bullet resistant. One skilled in the art will recognize that the support posts 12 at the ultimate ends of the security fence 10 would need to have a securement device 16 attached to the back side of the support post 12 to integrate the end support post 12 and the adjacent panel 12. Alternatively, each support post could carry a securement device 16 for each adjacent panel 15 to draw the panels 15 into the support post 12 individually.

Figure 6:
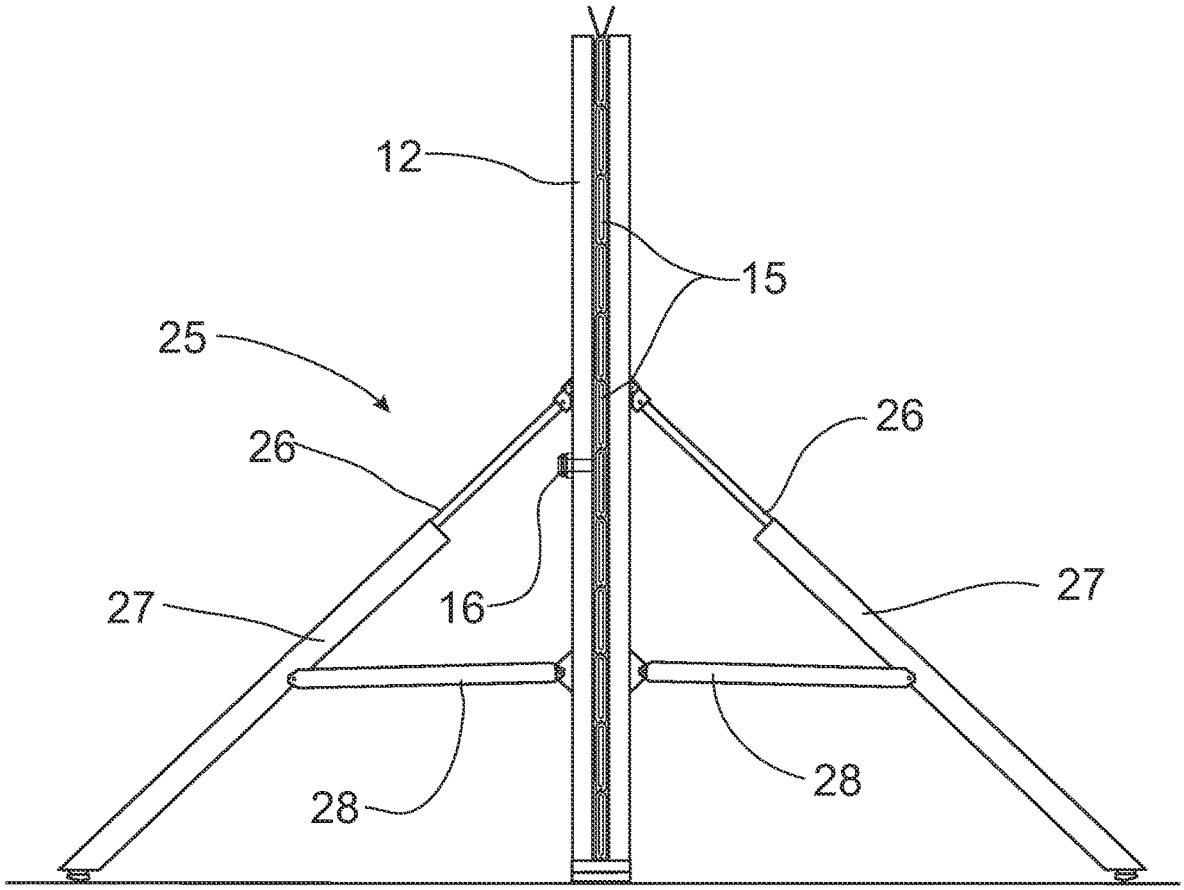
FIG. 6 is a cross-sectional view of the security fence similar to that of FIG. 3, but depicting an alternative support member that can be adjusted for use on an uneven base, the alternative support member being shown, however, on a level base.
Figure 7:
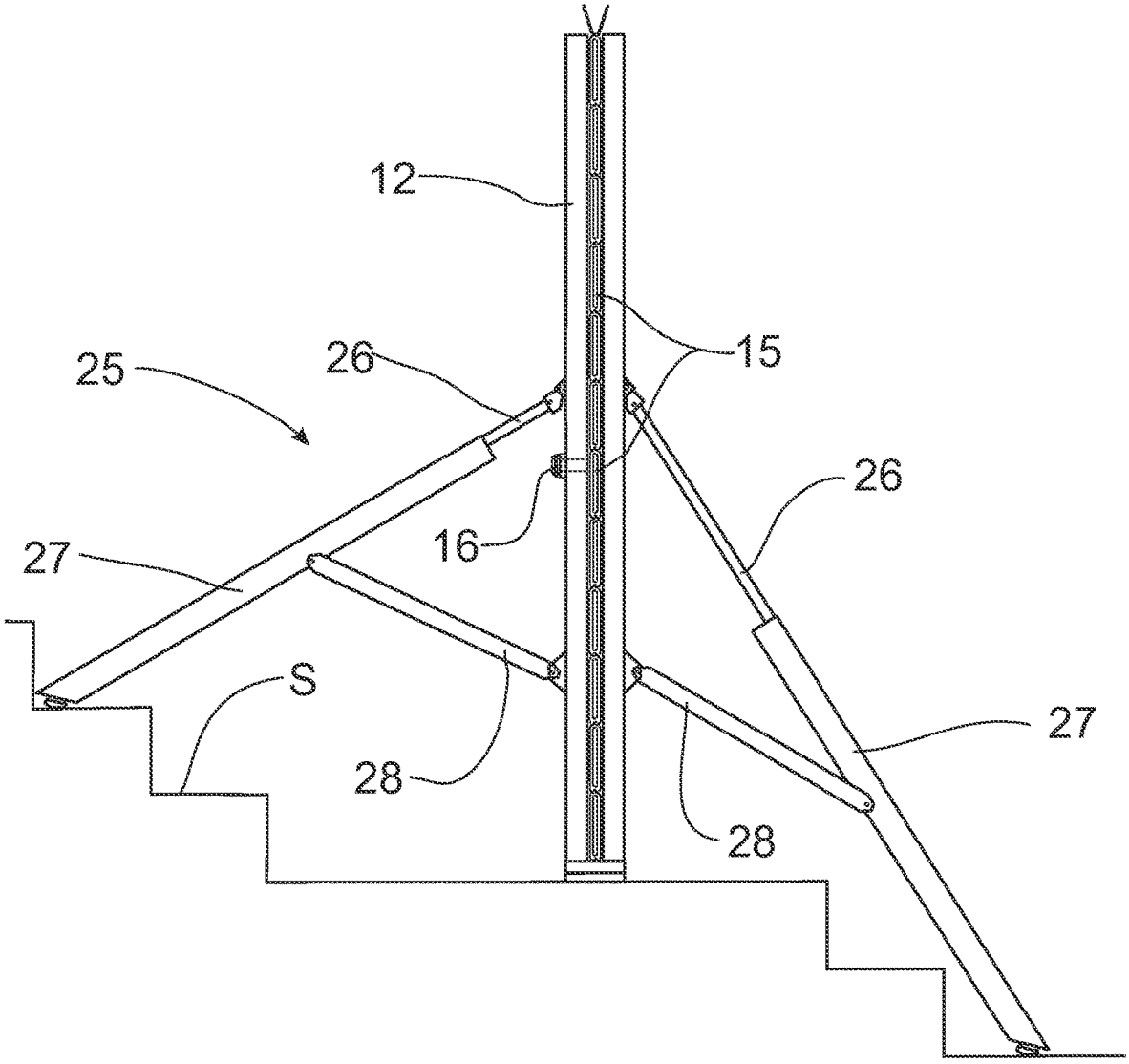
FIG. 7 is a cross-sectional view of the security fence similar to that of FIG. 6, but showing appropriate adjustments for deployment of the security fence on an uneven base, such as steps.

Referring now to FIGS. 6 and 7, an alternative, adjustable support structure 25 can best be seen. The adjustable support structure 25 includes a telescopic leg 26 pivotally connected to the support post 12 and is selectively extendable in length. A fixed length arm 28 interconnects the base 27 of the telescopic leg and the support post 12 to stabilize the selected position of the telescopic leg 26. As seen in FIG. 6, this adjustable support structure 25 can be utilized on even, level ground, or other underlying base. As can be seen in FIG. 7, this adjustable support structure 25 can be utilized on uneven ground or underlying base, such as steps S as is shown in FIG. 7. In such situations, the adjustable leg 26 is adjusted in length to fit against an appropriate position on the underlying base S, while the fixed length arm 28 pivots with the adjustable leg 26 to keep the adjustable length leg 26 stable.

The adjustable support structure 25 is particularly adapted for use in deploying the bullet resistant fence 10 quickly in urban settings. The adjustable length legs 57 can be positioned to accommodate steps, curbs and other uneven underlying bases. The support structures 20, 25 can be maneuvered into position to form a temporary bullet resistant security fence 10 manually by using a dolly and roller system or via a specialized mechanism that can hoist the panels via a mobile crane or lift system. Such a rapidly deployable bullet resistant security fence 10 can offer modular semi-permanent fencing for diplomatic safe havens, military bases and commercial establishments to provide safety from firearms in hostile areas.

As is depicted in FIGS. 8-17, the panels 15 can be configured in different manners. The preferred construction of the front and rear shells 17, 18 of the panels 15 is a single formed sheet of aluminum, preferably being formed from an aluminum sheet that is about ⅛ inch thick and formed with repeated V-shaped indentations 14 to provide an aesthetically pleasing exterior appearance. The vertices of the V-shaped indentations 14 engage a ballistic core 15*a* located between the front and rear shells 17, 18.

Figure 11:
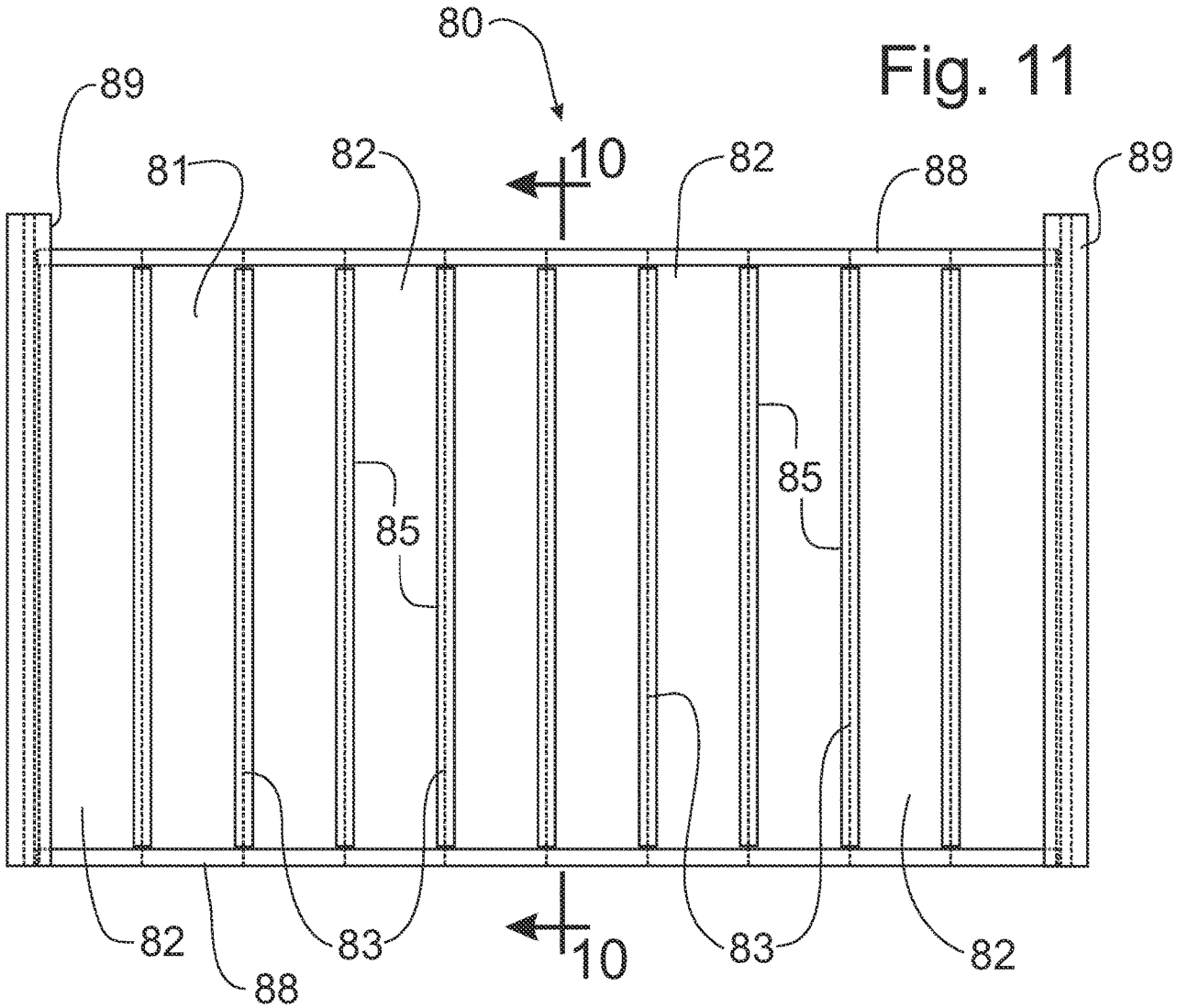
FIG. 11 is an elevational view of a second alternative configuration of the rapidly deployable security fence.
Figure 10:
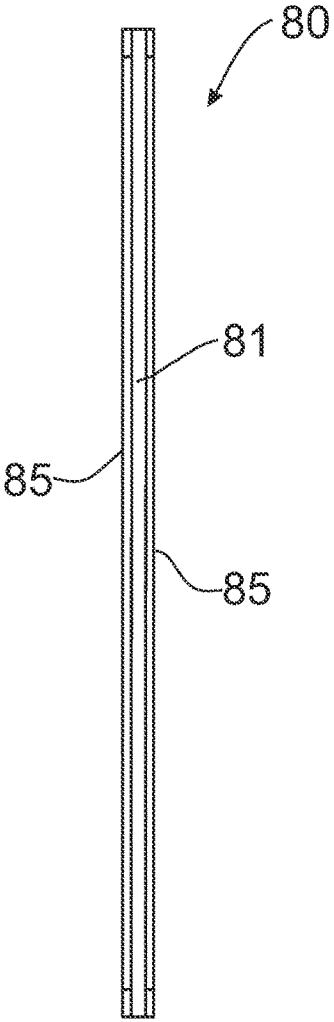
FIG. 10 is a cross-sectional view of the panel corresponding to the lines 10-10 in FIG. 11.
Figure 13:
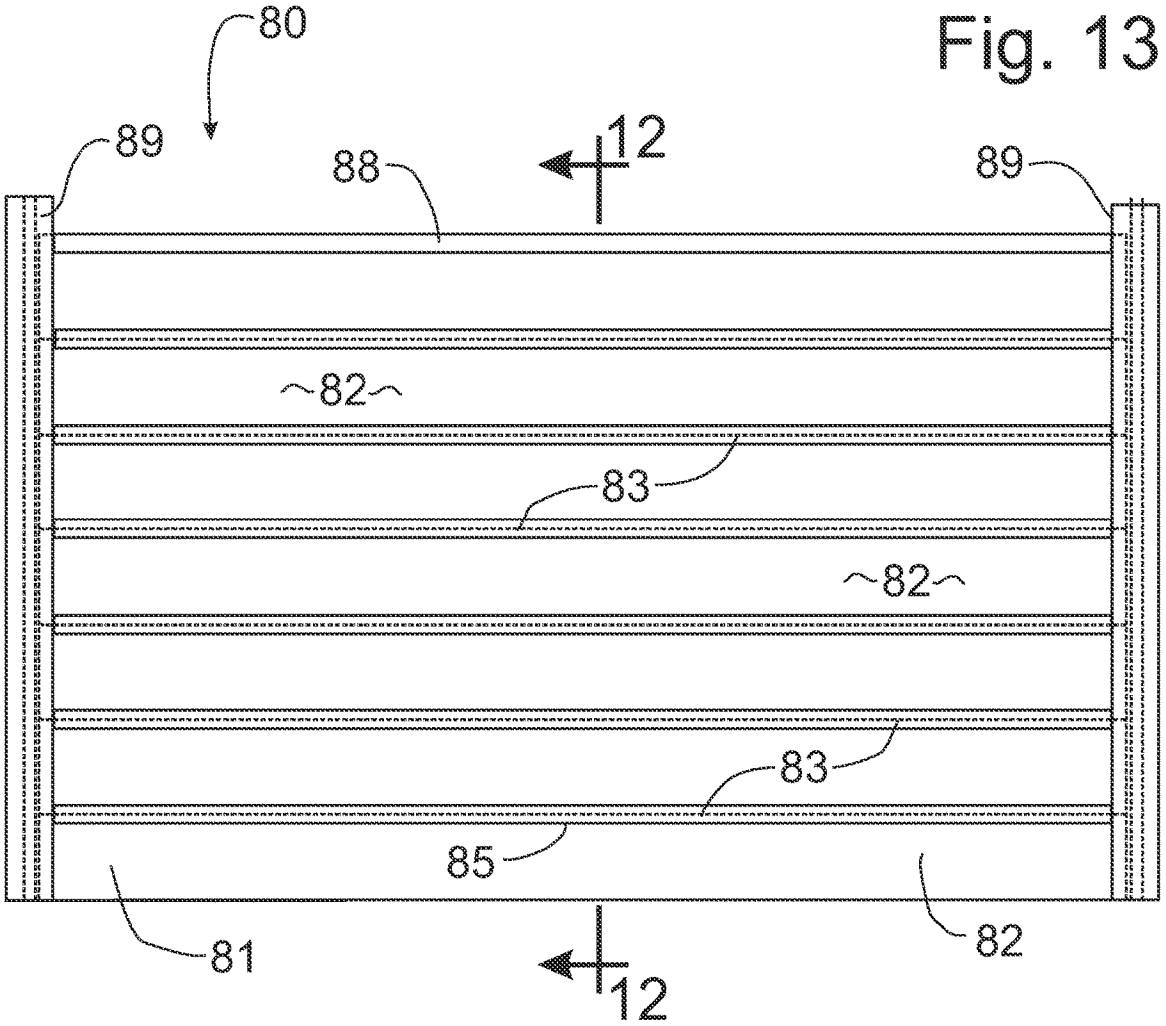
FIG. 13 is an elevational view of the third alternative configuration of the rapidly deployable security fence.
Figure 12:
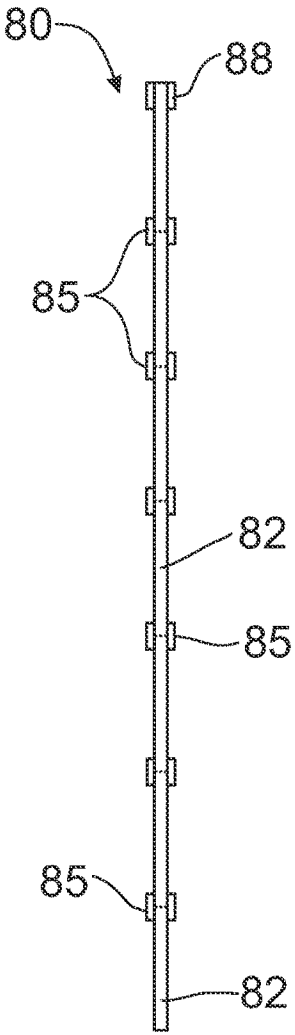
FIG. 12 is a cross-sectional view of a third alternative configuration of the rapidly deployable security fence.
Figure 14:
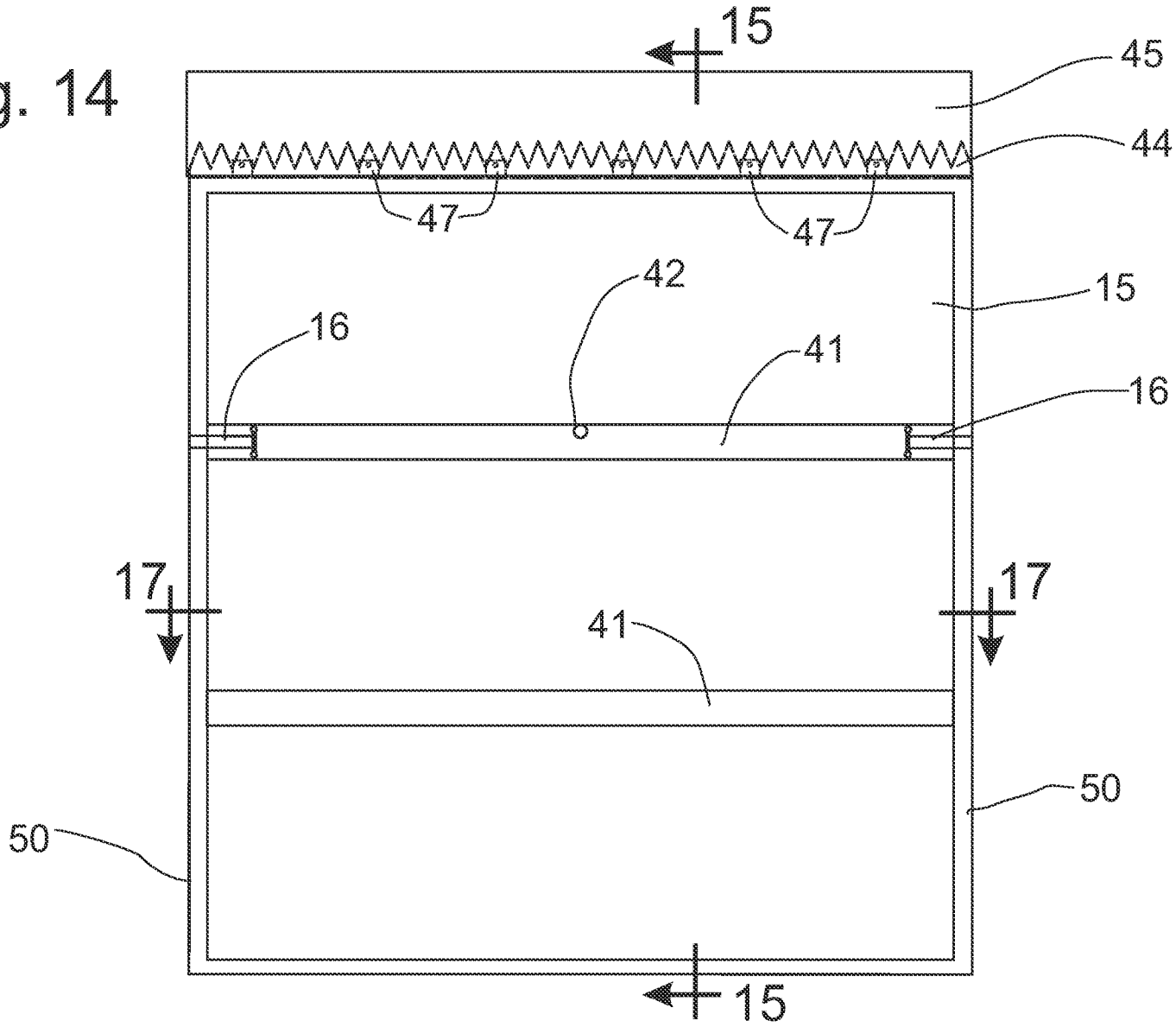
FIG. 14 is an elevational view of a fourth alternative embodiment of the rapidly deployable security fence having sharp saw teeth devices mounted on the top thereof.

Referring now to FIGS. 10 and 11, a different alternative security fence configuration 80 can best be seen. The panel 81 extends between adjacent support posts 12, but is formed from a plurality of 6061 or 6063 aluminum vertical strips 82 to provide a reduced cost and ease of manufacturing standpoint. The vertical strips 82 can be welded along the vertical edges thereof, forming a seam 83 between adjoining vertical strips 82. To maintain bullet resistance integrity for the security fence 80, the seams 83 are covered front and back by a vertical flat lathe 85, preferably formed from 6061 or 6063 aluminum having dimensions between 3⁄16 inch and ⅝ inch and widths of between 1½ inches and 2 inches, depending on the level or class of ballistic protection desired. For aesthetic purposes, the security fence 80 can be formed with a horizontally extending upper and/or lower trim pieces 88 having the same dimensions as the lathe 85 and extending along the top and/or lower edges of the aluminum panel 81 between the opposing support posts 89. As is best seen in FIGS. 12 and 13, the orientation of the aluminum strips 82 and the lathes 85 can be made horizontal, rather than vertical, to provide a different aesthetic appearance for the security fence. As described above with respect to FIGS. 10 and 11, the dimensions and configurations of the aluminum plate panel 81 are the same, except that the orientation is horizontal instead of vertical.

As shown in FIGS. 14-17, the panels 15 can incorporate devices 44, 45 to resist scaling or climbing over the panels 15. The panels 15 can be formed according to any of the various configurations described above, and have securement devices 16 to integrate the panels 15 into a security fence structure in conjunction with the support posts 12.

Each panel can include aluminum reinforcement beams 41 to provide additional stability for the panel 15 and provide a mounting location for the securement devices 16. An additional optional feature that can be provided is a sight glass 42 that would permit a visual image of whatever is happening on the opposite side of the panel 15.

For placement along the upper edge of the panel 15, an anti-scaling device can include a saw-tooth strip 44 which can be welded to the upper edge of the panel 15. One form of a saw-tooth strip 44 that can be used is an agricultural cutter bar formed from an elongated steel bar having sharp triangular teeth affixed to the bar, preferably by welding, in a linear manner and then secured to the upper edge of the panel 15. Also, each panel 15 can include a formed deflector 45 that can deter people from climbing over the top of the panel 15. The deflector 45 can be secured by bolts 46 that pass through mounting tabs 47 affixed to the upper edge of the panel 15, and also through the saw-tooth strip 44. As is best seen in FIGS. 15-17, the upper and lower edges of the panel 15, as well as the opposing side edges of the panel 15, can include formed extrusions 50 to provide additional stability and structural integrity for the panel 15.

One skilled in the art will recognize that the portable, rapidly deployable security fence 10 can be constructed according to any of the configurations defined above, and can include fixed or adjustable support structure 12, 20, securement devices 16, anti-scaling devices 44, 45, as desired. The preferred security fence structure 10 would include an aluminum front and rear shells 17, 18 with a sheet of pressed ballistic material forming a ballistic core 15*a* between the front and rear shells 17, 18 secured along the upper, lower and side edges by an aluminum extrusion 50. The thickness of the front and rear shells 17, 18 and the number of layers of ballistic material formed into the pressed ballistic material forming the ballistic core 15*a* will be selected to conform to the desired level of ballistic protection to be provided in the security fence 10.

Referring now to FIGS. 18-24, the details of a different embodiment of the fixed base stabilizing apparatus 60 can best be seen. The flat base member 61 is elongated to provide stability from tipping. In the end of the flat base member 61, a set of four brackets 62 are provided to enable the flat base member 61 to be nailed or otherwise secured to the underlying strata through openings in the brackets 62. The central portion provides a device 65 for mounting the support post 72 that includes a set of tangs 66 that are fixed to the flat base member 61 and project upwardly therefrom to receive the support post 72. The tangs 66 are closely arranged so as to allow the thickness of the support post 72 to fit between and around the tangs 66, as depicted in the dashed lines in FIG. 18. A hole 67 is formed in two of the tangs 66 closest to the brackets 62 to allow for a bolt (not shown) to connect through a corresponding hole through the support post 72 to the device 65 for mounting the support post 72.

In FIGS. 22-24, the details of the support post 72 can best be seen. The support post 72, as described above with respect to the support post 12, is an H-Beam or I-Beam configuration, but is also preferably formed with wrap around flanges 73 that encircle the tangs 66, in addition to a central web 74 that is received between the tangs 66 as is depicted in FIGS. 18 and 21. The support post 72 can have a height that corresponds to the height of the panel 15 to be supported on the support post 72, which can be preferably between 6 and 10 feet high. The support post 72 includes a plurality of optional cable mounts 75 that can be formed as triangular brackets with an opening passing horizontally therethrough for the passage of a cable (not shown) that would be anchored at the opposing ends thereof and pass through corresponding cable mounts 75 on successive support posts 72.

The use of multiple cables passing along the rear of the support posts 72 are various heights establishes a substantial amount of crash protection for the security fence 10, in addition to being resistant to the passage of bullets as is described in greater detail above, even though the security fence structure 10 was deployed rapidly and is portable to the place of installation. The support post 72 also includes a connection bracket 76 within the array of cable mounts 75 for the attachment of the fixed length arms 28 on opposing sides of the support post 72 which connect to the variable length legs 57 forming a part of the adjustable support structure 25 described above in greater detail with respect to FIGS. 6 and 7.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

In the way of examples, the panels could be formed by a plurality of horizontally extending panel strips that are arranged in a vertical manner to form the completed panel 15. Such horizontally extending panel strips would be stacked between the adjacent support posts 15 and would preferably have interlocking structures that maintain ballistic integrity, similar to that disclosed in U.S. Pat. No. 11,747,114, granted on Sep. 5, 2023, the content of which is incorporated herein by reference. Such horizontally extending panel strips can be captured by the extrusions 50 along the upper and lower edges of the panel 15. Furthermore, a cable can be extended through selected panel strips to establish a measure of vehicle crash protection.

What is claimed is:

1. A bullet resistant security fence, comprising:

a plurality of support posts including end support posts and intermediate support posts between said end support posts, said support posts being spaced apart a predetermined distance, each said support post having a stabilizing apparatus operable to keep the support post in an upright orientation;

a plurality of formed panels oriented in a vertical manner between adjacent support posts to define a bullet resistant portion of said security fence, each said panel having a length dimension corresponding to said predetermined distance so that said panels can extend between said adjacent support post, each said panel having a front shell and a rear shell forming a solid barrier between adjacent said support posts; and a securement device corresponding to each said intermediate support post to integrate adjacent panels on each opposing side into said intermediate support post, said securement device being connected to the rear shell of each panel adjacent to the corresponding said intermediate support post to draw the adjacent panels into engagement with the intermediate support post without exposing said securement device to being accessible from the front shell of the adjacent panels.

2. The security fence of claim 1 wherein each said panel includes a ballistic core in a cavity between said front and rear shells.

3. The security fence of claim 2 wherein said ballistic core is formed from multiple layers of ballistic material.

4. The security fence of claim 3 wherein said ballistic core is formed from multiple layers of ballistic material pressed into a sheet.

5. The security fence of claim 2 wherein said front and rear shells are formed from strips of aluminum welded together seams with aluminum lath covering said seams.

6. The security fence of claim 1 wherein said stabilizing apparatus is formed as an elongated base member oriented with said support post being substantially in the center thereof, said base member including a web member extending upward from said base member on opposing sides of said support post and being secured to the corresponding side of said support post.

7. The security fence of claim 6 wherein said base member, said web member and said support post are integral parts of said stabilizing apparatus.

8. The security fence of claim 1 wherein said stabilizing apparatus is formed with a pair of adjustable length telescopic legs pivotally connected, respectively, to opposing sides of said support post.

9. The security fence of claim 8 wherein each said telescopic leg is connected to a stabilizing arm pivotally attached to the corresponding side of said support post.

10. The security fence of claim 1 further comprising at least one anti-scaling device secured to an upper edge of each said panel.

11. The security fence of claim 10 wherein said at least one anti-scaling device is a strip of saw-tooth blades secured to said upper edge of each said panel.

12. The security fence of claim 10 wherein said at least one anti-scaling device is a curved deflector member.

13. The security fence of claim 1 further comprising at least one anti-scaling device from a group including a strip of saw-tooth blades and a curved deflector.

14. A portable security fence comprising:

a plurality of support posts spaced at predetermined distances, each said support post including a stabilizing apparatus to maintain the support post in a vertical orientation;

a vertically oriented panel positioned between each pair of support posts, each said panel being received by the corresponding support posts to present a solid barrier between each respective pair of support posts, each panel including a front shell and a rear shell; and a securement device corresponding to each respective said support post and connected to the rear shell of each said panel adjacent to the respective said support post, said securement device passing around a rearward side of the support post so as not to be accessible from said front shell adjacent said support post to draw each panel into engagement with the adjacent support post.

15. The security fence of claim 14 wherein each panel further includes a ballistic core in a cavity between said front and rear shells to create a bullet resistant panel.

16. The security fence of claim 15 wherein said ballistic core is formed of multiple layers of pressed ballistic material.

17. The security fence of claim 14 wherein said stabilizing apparatus is formed as an elongated base member oriented with said support post being substantially in the center thereof, said base member including a web member extending upward from said base member on opposing sides of said support post and being secured to the corresponding side of said support post.

18. The security fence of claim 14 wherein said stabilizing apparatus is formed with a pair of adjustable length telescopic legs pivotally connected, respectively, to opposing sides of said support post.

19. A rapidly deployable portable security fence comprising:

a plurality of support posts spaced at predetermined distances, each said support post including a stabilizing apparatus to maintain the support post in a vertical orientation, each said support post being mounted on a flat base member having a central set of tangs arranged for the support post to fit between and to wrap around said tangs;

a vertically oriented panel positioned between each pair of support posts, each said panel being received by the corresponding support posts, each said panel including a front shell, a rear shell and a ballistic core in a cavity between said front and rear shells to create a bullet resistant panel, each said support post including a stabilizing apparatus to maintain the support post in a vertical orientation; and a securement device corresponding to each said support post to draw each adjacent panel into engagement with the support post.

20. The rapidly deployable portable security fence of claim 19 wherein said support posts have a hole therethrough aligned with corresponding openings in the tangs to accept fastener to secure the support post to the tangs.

* * * * *